United States Patent [19]

Johnson

[11] 3,957,095

[45] May 18, 1976

[54] ROUGH HEWN BENCH PLANE ATTACHMENT

[76] Inventor: Glen E. Johnson, Baldwin Hill Road, Brookfield, Conn. 06804

[22] Filed: Nov. 6, 1974

[21] Appl. No.: 521,517

[52] U.S. Cl. ..... 145/5 R; 144/137; 144/142; 144/309 A; 144/323; 145/10; 145/11

[51] Int. Cl.[2] ..... B27G 17/02

[58] Field of Search ..... 145/10, 5 R, 11; 144/137, 142, 309 A, 321, 323; 46/211, 221, 96

[56] References Cited

UNITED STATES PATENTS

| | | | |
|---|---|---|---|
| 107,757 | 9/1870 | Callahan | 145/5 R |
| 375,904 | 1/1888 | Vicken | 144/142 |
| 678,309 | 7/1901 | Traut | 145/10 |
| 707,356 | 8/1902 | Riecker et al. | 145/5 R |
| 1,577,743 | 3/1926 | Gossett | 46/211 UX |
| 1,681,666 | 8/1928 | Higgins | 46/96 X |
| 2,712,711 | 7/1955 | Leyden | 46/221 X |
| 2,908,997 | 10/1959 | Handler | 46/221 X |

FOREIGN PATENTS OR APPLICATIONS

| | | | |
|---|---|---|---|
| 241,930 | 8/1946 | Switzerland | 46/221 |

*Primary Examiner*—Al Lawrence Smith
*Assistant Examiner*—J. T. Zatarga
*Attorney, Agent, or Firm*—Mattern, Ware, Davis & Stoltz

[57] ABSTRACT

The rough hewn bench plane attachment of the present invention allows a standard bench plane to be converted into a hewing tool that is able to create hewn lumber similar in shape and design to hand-hewn lumber. The attachment incorporates a chassis assembly mounted under the front knob of the bench plane. An eccentric rolling assembly connects to the chassis assembly and causes an eccentric rolling effect as it rolls over the lumber. This eccentric movement of the wheels causes the bench plane to correspondingly move in an eccentric manner with respect to the workpiece so that a cutting iron of the invention replacing the regular cutting iron of the plane generates varying depth gouges in the lumber workpiece. The cutting iron of the invention has an arcuate cutting edge that enhances the hewing of the lumber by varying the transverse depth of the cutting edge in the lumber workpiece. Forward motion of the adapted bench plane causes repeated non-uniform gouging of the lumber workpiece with a resultant hand-hewn appearance.

13 Claims, 6 Drawing Figures

FIG. 4
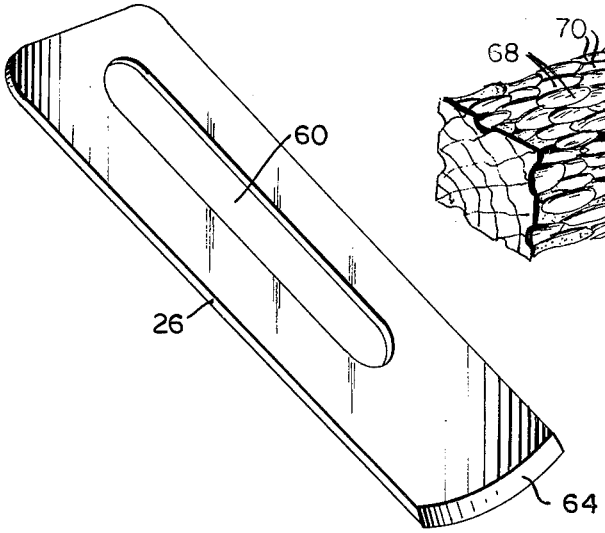
FIG. 6
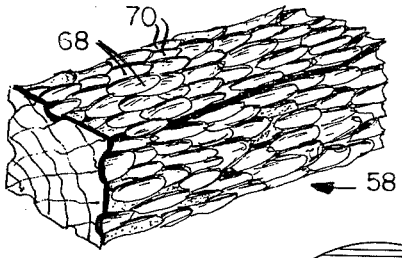
FIG. 2
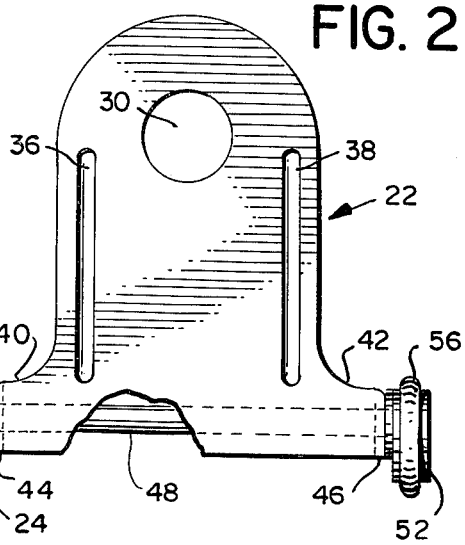
FIG. 3
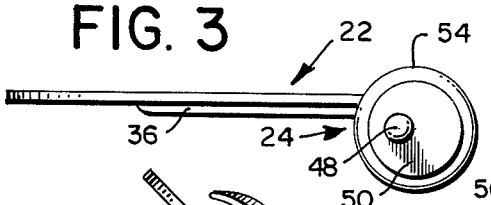
FIG. 1
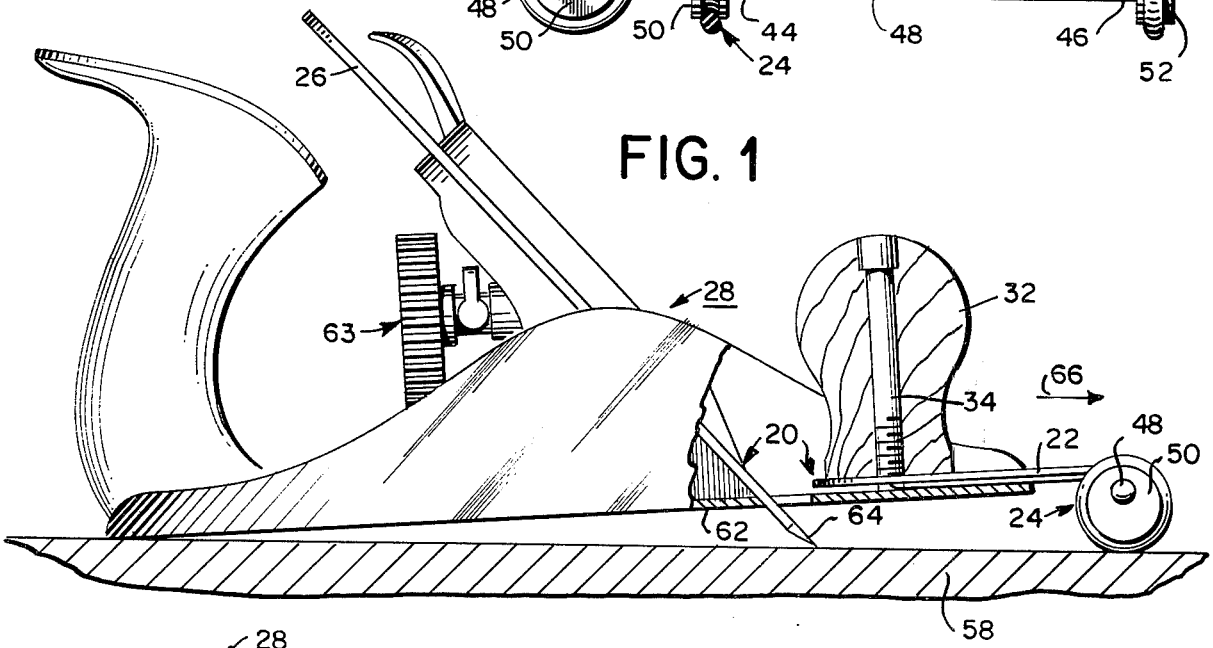
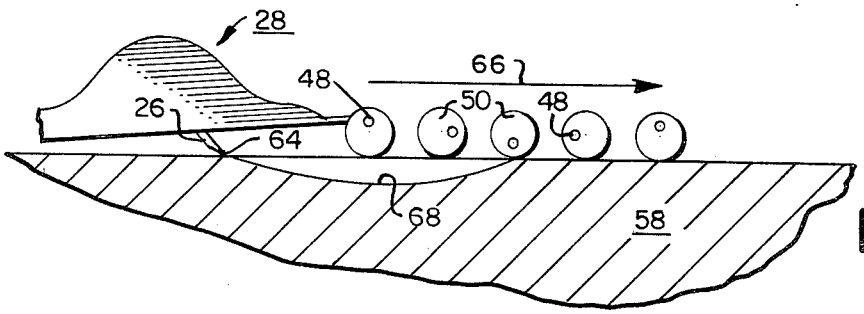
FIG. 5

ROUGH HEWN BENCH PLANE ATTACHMENT

BACKGROUND OF THE INVENTION

Although some prior art patents, such as U.S. Pat. Nos. 1,775,430 Hibbs, 2,069,923 Olson, 2,043,509 Easters, and 2,497,701 Telasky have taught devices resembling bench planes and incorporating some type of roller or rollers, they are however very different from the present invention and in no way teach the present invention. Thus, the Telasky patent teaches a chip-guiding roller which does not contact the work surface, while the Easters device is a power driven plane. The Olson and Hibbs devices also show motor-driven grooving devices, wherein the Olson devices slides on a set of skids.

None of these patents teach the hewing of a lumber workpiece, and none show or teach the use of eccentric rollers to accomplish the hewing of lumber. Consequently, none of these prior art inventions generate a variation in the depth of planing, filing, or gouging as these devices are moved over a workpiece, but indeed seek to accomplish the opposite result; mainly, the smooth planing of a workpiece. Consequently, none of these prior art devices in any way teach the new and useful features of the present invention.

More particularly, the chassis and eccentric rolling assemblies of the present invention, in conjunction with the arcuate cutting edge of the cutting iron mount on a standard bench plane to convert the plane into a device that generates varying depths gouges into a workpiece as the plane is moved in a linear fashion across the workpiece. By varying the downward protrusion of the cutting edge of the cutting iron below the lower surface of the bench plane, various shaped hand-hewn appearing designs may be generated in the workpiece by the present device.

SUMMARY OF THE INVENTION

The rough hewn bench plane attachments of the present invention allow a standard bench plane to be converted into a device that is capable of creating hewn lumber similar in appearance to hand-hewn lumber. Such hand-hewn lumber has generally been made with the use of an adze requiring great skill and patience to generate a pleasing hewn appearance in the piece of lumber.

The present invention alleviates this arduous, time consuming operation by providing devices that allow inexperienced users to generate hewn lumber.

The present invention incorporates chassis and rolling assemblies. The chassis mounts under the front knob of a standard bench plane. The forward portion of the chassis assembly connects with the rolling assembly that incorporates an off-centered axle mounted to two wheels causing eccentric rolling of these wheels as they are move along a workpiece. This eccentric motion is communicated to the bench plane thereby causing the cutting iron of the present invention to vary its vertical displacement with respect to the workpiece. The cutting iron of the present invention incorporates an arcuately-shaped cutting edge that varies the transverse depth of the groove generated in the lumber workpiece. Thus, a compound curvilinear surface is formed in the workpiece by the present invention during each revolution of its off-centered wheels.

This transverse depth variation combined with the eccentric longitudinal penetration of the cutting edge in the lumber workpiece as the plane is moved along the workpiece generates a natural hewned lumber appearance. Variation of the protrusion of the cutting edge of the cutting iron below the lower surface of the bench plane provides for various depth hewing gouges in the workpiece.

OBJECTS OF THE INVENTION

It is therefore a principal object of the present invention to provide a hewing attachment to a standard bench plane that is able to convert the standard bench plane into a device for hewing lumber in an efficient manner.

It is another object of the present invention to provide an attachment for bench planes of the above description that is easy to operate.

A further object of the present invention is to provide an attachment for a standard bench plane that is inexpensive to manufacture.

A still further object of the present invention is to provide an attachment for standard bench planes that allows the user to generate various shaped hewing gouges in a lumber workpiece.

Other objects of the present invention will in part be obvious and will in part appear hereinafter.

The invention accordingly comprises the features of construction, combination of elements, and arrangement of parts which will be exemplified in the construction hereinafter set forth, and the scope of the invention will be indicated in the claims.

THE DRAWINGS

For a fuller understanding of the nature and objects of the invention, reference should be had to the following detailed description taken in conjunction with the accompanying drawings, in which:

FIG. 1 is a side elevational partially cut away view of a rough hewn bench plane attachment of the present invention installed in a standard bench plane;

FIG. 2 is a top plan view partially cut away of the chassis assembly and rolling assembly of the bench plane attachment shown in FIG. 1;

FIG. 3 is a side elevational view of the chassis assembly and rolling assembly of FIG. 2;

FIG. 4 is a perspective view of a cutting iron of the bench plane attachment shown in FIG. 1;

FIG. 5 is a diagrammatic cross-sectional side elevational view of the present invention depicting the movement of the cutting iron of the present invention as related to the rotation of the wheels of the present invention, showing in enlarged form the removal of material from the workpiece by the cutting iron; and FIG. 6 is a perspective view of a workpiece after it has been hewed by a standard bench plane incorporating the hewn bench plane attachment shown in FIG. 1.

DETAILED DESCRIPTION

As is best seen in FIGS. 1, 2, 3 and 4, a rough hewn bench plane attachment 20 incorporates a chassis assembly 22, a roller assembly 24, and a cutting iron 26. As seen in FIG. 1, the bench plane attachment 20 mounts to a standard bench plane 28 to convert the bench plane into a hewing tool that is able to create hewn lumber similar in shape and design to hand-hewn lumber.

As best seen in FIGS. 1, 2 and 3, the chassis assembly is substantially planar in configuration and incorporates a mounting aperture 30 for affixing the chassis to the forward portion of the bench plane under a knob 32 of the bench plane. A mounting bolt 34 secures the chassis assembly between the knob and the front portion of the plane. As seen in FIGS. 2 and 3, a pair of parallel downwardly indented grooves 36 and 38 are incorporated in the chassis assembly in order to provide structural rigidity to the chassis. The chassis assembly terminates at its forward end with a pair of outwardly extending legs 40 and 42; each leg incorporating a downwardly depending tab 44 and 46 respectively (shown in phantom).

The eccentric rolling assembly 24 connects to the chassis assembly 22 via an axle 48 passing through mounting apertures (not shown) in downwardly depending tabs 44 and 46. The axle is rigidly mounted in an eccentric configuration to guiding wheels 50 and 52. Rubber rings 54 and 56 are respectively mounted to wheels 50 and 52 in order to increase the frictional force of the rolling assembly as it rolls along a workpiece 58.

Due to the eccentric placement of axle 48 with respect to wheels 50 and 52, the rolling of the wheels along a workpiece causes a variation in the height of axle 48 with respect to the workpiece. This variation in height causes a similar variation to the chassis assembly 22 and therefore imparts this variation in vertical displacement to the bench plane 28.

As can best be seen in FIG. 1, the cutting iron 26 of the present invention is mounted to the standard bench plane and replaces the cutting iron of the standard bench plane. As seen in FIG. 4, the cutting iron of the present invention incorporates a longitudinally extending mounting aperture 60 that interfits with a locking and adjusting mechanism 63 of the bench plane so as to enable the cutting iron to be extended below the lower surface 62 of this standard bench plane at any desired depth. The cutting iron incorporates an arcuately-shaped cutting edge 64 that engages with and cuts into the lumber workpiece 58 to produce gouges similar in appearance to hand-hewn gouges. The longitudinal aperture 60 allows repositioning of the cutting iron with respect to the cap iron of the standard locking and adjusting mechanism 63 so as to allow sharpening of cutting edge 64.

The actual hewing of a workpiece by the present invention is best seen in FIGS. 1 and 5. As shown diagrammatically in FIG. 5, as a bench plane incorporating the present invention is rolled in a direction shown by arrow 66, the wheels 50 and 52 of the rolling assembly rotate upon the workpiece 58. As the wheels make one complete revolution, the axle 48 subtends a circular path with respect to the workpiece causing the cutting edge 64 of the cutting iron 26 to protrude and cut into the workpiece in an arcuate manner shown by gouge 68. Since the cutting edge has an arcuate transverse shape, the depth that the cutting edge cuts into the workpiece at any given position of wheels 50 and 52 also varies causing the cross-sectional removal of material from the workpiece to be arcuate. The resultant gouge into the workpiece is thus of a compound curvilinear configuration as best seen in FIG. 6. This gouge is very similar to the gouge created when a workpiece is hewn by a present-day adze. Since the protrusion of the cutting edge 64 with respect to the lower surface of the bench plane may be varied by the user, the depth of the gouging of the workpiece by the cutting edge may similarly be varied. Thus, gouges 68 and 70 have different shapes due to the different protrusion of the cutting edge below the lower surface of the bench plane.

Thus by installing the present invention on a standard bench plane, a user can readily create hand-hewn appearing lumber. As best seen in FIG. 1, once installed, the bench plane is merely moved in a longitudinal direction, shown by arrow 66, along workpiece 58, causing wheels 50 and 52 to rotate. This rotation causes the cutting edge 64 of the cutting iron to cyclically cut into the workpiece causing resultant gouges similar in appearance to hand-hewn gouges.

Removal of the cutting iron and chassis assembly from the standard bench plane is easily accomplished so as to allow a bench plane to be used in its standard configuration.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. An improved bench plane having a lower surface and a forward end, wherein the improvement comprises:

A. a chassis mounted to the forward end of said bench plane;

B. means for 360° rotational eccentric rolling rotatably connected to the chassis; and C. a cutting iron adjustably positioned within said bench plane having a cutting edge projectable beneath the lower surface of said bench plane;

whereby forward movement of the bench plane causes the eccentric rolling means to continuously rotate in an eccentric manner thereby causing the cutting edge to remove material from the workpiece so as to form gouges therein.

2. An improved bench plane as defined in claim 1, wherein said eccentric rolling means incorporates an axle eccentrically mounted to a pair of wheels, wherein said axle interfits with said chassis.

3. A bench plane attachment as defined in claim 1, wherein the cutting edge of said cutting iron is arcuate.

4. An improved bench plane as defined in claim 1, wherein said cutting iron is of a generally elongated, rectangular configuration having a centrally located longitudinal mounting aperture for facilitating sharpening of said cutting edge.

5. An improved bench plane as defined in claim 1, wherein the bench plane has a forward knob and said chassis incorporates a mounting aperture for installing said chassis beneath the forward knob of the bench plane.

6. An improved bench plane as defined in claim 5, wherein said chassis further incorporates a generally rectangular configuration having a pair of depending apertured tabs at a forward end thereof for engaging with said eccentric rolling means.

7. An improved bench plane as defined in claim 6, wherein said chassis further incorporates downwardly indented ribs for providing structural rigidity to said chassis.

8. An apparatus for hewing a lumber workpiece, comprising:

A. a bench plane having a lower surface and a forward end;

B. a chassis mounted to the forward end of said bench plane;

C. means for 360° rotational rolling rotatably connected to the chassis; and

D. a cutting iron adjustably positioned within the bench plane, said iron having an arcuate cutting edge projectable beneath the lower surface of said bench plane;

whereby forward movement of the apparatus causes the eccentric rolling means to continuously rotate in an eccentric manner, thereby causing the cutting edge to remove material from the workpiece.

9. An apparatus for hewing a lumber workpiece as defined in claim 8, wherein the eccentric rolling means incorporates an axle eccentrically mounted to a pair of wheels, wherein said axle rotatably interfits with said chassis.

10. An improved bench plane having a lower surface and a forward knob, wherein the improvement comprises:

A. a chassis having a mounting aperture for installing said chassis beneath the forward knob of the bench plane, said chassis incorporating a generally rectangular configuration having a pair of depending apertured tabs at a forward end thereof;

B. means for eccentric rolling rotatably connected to the chassis through the apertured tabs of the chassis; and C. a cutting iron adjustably positioned within said bench plane having a cutting edge projectable beneath the lower surface of said bench plane;

whereby forward movement of the bench plane causes the eccentric rolling means to rotate in an eccentric manner, thereby causing the cutting edge to remove material from the workpiece so as to form gouges therein.

11. An improved bench plane as defined in claim 10, wherein said chassis further incorporates downwardly indented ribs for providing structural rigidity to said chassis.

12. An improved bench plane having a lower surface and a forward end, wherein the improvement comprises:

A. a chassis mounted to the forward end of said bench plane;

B. means for eccentric rolling incorporating an axle eccentrically mounted to a pair of wheels, said axle rotatably interfitting with said chassis; and C. a cutting iron adjustably positioned within said bench plane having a cutting edge projectable beneath the lower surface of said bench plane;

whereby forward movement of the bench plane causes the eccentric rolling means to rotate in an eccentric manner, thereby causing the cutting edge to remove material from the workpiece so as to form gouges therein.

13. An apparatus for hewing a lumber workpiece comprising:

A. a bench plane having a lower surface and a forward end;

B. a chassis mounted to the forward end of said bench plane;

C. means for eccentric rolling incorporating an axle eccentrically mounted to a pair of wheels, said axle rotatably connected with said chassis; and D. a cutting iron adjustably positioned within the bench plane, said iron having an arcuate cutting edge projectable beneath the lower surface of said bench plane;

whereby forward movement of the apparatus causes the eccentric rolling means to rotate in an eccentric manner, thereby causing the cutting edge to remove material from the workpiece.

* * * * *